United States Patent [19]

Usami et al.

[11] Patent Number: 4,644,376

[45] Date of Patent: Feb. 17, 1987

[54] HEAT-SENSITIVE RECORDING MATERIAL

[75] Inventors: Toshimasa Usami; Toshiharu Tanaka, both of Shizuoka, Japan

[73] Assignee: Fuji Photo Film Co., Ltd., Kanagawa, Japan

[21] Appl. No.: 729,722

[22] Filed: May 2, 1985

[30] Foreign Application Priority Data

May 2, 1984 [JP] Japan ..... 59-89718
May 17, 1984 [JP] Japan ..... 59-99489

[51] Int. Cl.[4] ..... B41M 5/18
[52] U.S. Cl. ..... 346/215; 346/204; 427/150; 427/151
[58] Field of Search ..... 346/204, 215, 214; 427/150, 151, 152

[56] References Cited

FOREIGN PATENT DOCUMENTS 0150600 9/1982 Japan ..... 346/204
0185197 11/1982 Japan ..... 346/204
0187296 11/1982 Japan ..... 346/204
0045090 3/1983 Japan ..... 346/204

*Primary Examiner*—Bruce H. Hess
*Attorney, Agent, or Firm*—Sughrue, Mion, Zinn, Macpeak and Seas

[57] ABSTRACT

A heat-sensitive recording material is described, comprising a support having thereon a layer containing microcapsules containing at least a first coloring component capable of undergoing a coloring reaction and an organic solvent in a core, and at least a second component causing said coloring reaction with said first coloring component in the microcapsules, wherein two or more kinds of microcapsules comprising respective microcapsule walls having different glass transition points constitute said microcapsules.

12 Claims, 1 Drawing Figure

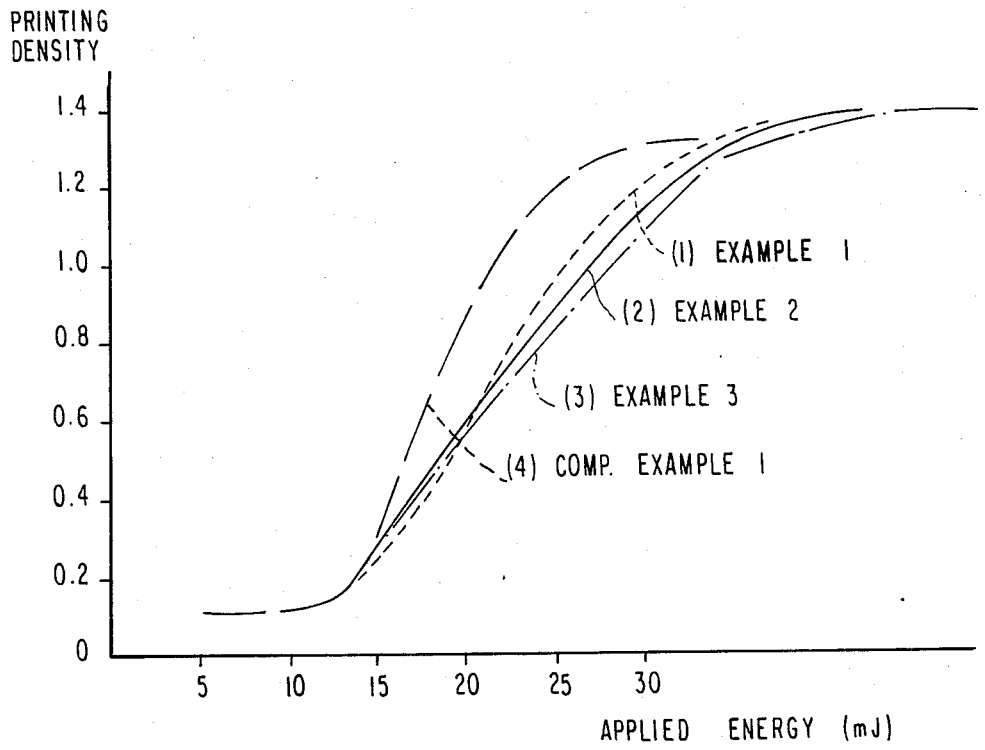
PRINTING DENSITY
1.4
1.2
1.0
0.8
0.6
0.4
0.2
0
5
10
15
20
25
30
APPLIED ENERGY (mJ)
(1) EXAMPLE 1
(2) EXAMPLE 2
(3) EXAMPLE 3
(4) COMP. EXAMPLE 1

HEAT-SENSITIVE RECORDING MATERIAL

FIELD OF THE INVENTION

The present invention relates to a heat-sensitive recording material, and particularly to novel heat-sensitive paper which is excellent in its thermal responsiveness and in which halftone images can be reproduced.

BACKGROUND OF THE INVENTION

Heat-sensitive recording includes advantages such as that (1) development is unnecessary, (2) when paper is selected as a support, the paper quality may be close to that of an ordinary paper, (3) handling is easy, (4) the colored images of high density can be provided, (5) a recording apparatus is inexpensive because of its simple structure, and (6) no noise is generated in recording. Thus, recently, use of heat-sensitive recording methods has rapidly spread in the fields of facsimile equipment and printers. As such a heat-sensitive recording material, mainly heat-sensitive recording material of the leuco color forming type which is excellent in its color forming density and its color forming speed has been used.

Generally, thus far, heat-sensitive recording has been mainly applied to character recording. Recently, however, the desire for picture recordings having gradation, such as a hard copy of a television picture, has been increasing. In general, there are two methods used for the expression of gradation, one being such that the recording density is fixed while a recording area is varied, and the other being such that a recording area is fixed while recording density is varied. The latter is superior to the former because not only is the resolving power low, but also the capability for expression of halftone by the former is inherently limited. The conventional heat-sensitive paper, however, is generally more adaptable for the former method, and does not have enough aptitude for the latter method. This is because, in the latter method, printing of half density is required with respect to the heat-sensitive paper. That is, the change in response is required to be limited with respect to the change in applied energy (that is, the rate of change is made to be gradual).

Conventional heat-sensitive recording paper of the leuco coloring type is, however, such that a leuco dye and a color developer of a phenol group are finely dispersed in size of micron order and mixed with each other and then applied onto a paper support and that the color components thereof are fused to be mixed with each other to form colors when heated by a thermal head. It is not easy to provide a difference in a temperature characteristic between particles or applied layer portions.

In conventional heat-sensitive paper, the rate of change in coloring density in response to applied energy (that is, the quantity of heat applied) is large and therefore low in recording with suitable gradation.

Various kinds of new functions have been required in such recording fields, and, for example, facsimile equipment for transmitting color documents, color printers, etc., have been developed. For these printing systems, an ink jet system, a thermal transfer system, or the like, is employed. These systems, however, have disadvantages such as that an ink nozzle may become clogged. In a heat-sensitive system, heat-sensitive paper capable of forming multicolors is known. For example, there are application of diazosulfonate, a combination of diazosulfonate and a leuco coloring system, etc. They are compounds producing a coloring reaction and require to have a difference in thermal responsiveness, so that color elements capable of being used are extremely limited and there are many restrictions in design and production of the recording materials.

SUMMARY OF THE INVENTION

A first object of the present invention is therefore to provide a heat-sensitive recording material which is superior in recording properties with gentle gradation and which has a high thermal coloring property.

A second object of the present invention is to provide a novel heat-sensitive recording material capable of forming multicolors.

A third object of the present invention is to provide a recording material which is excellent in its manufacturing aptitude and in its picture preservation property.

As a result of extensive research by the present inventors, the above-mentioned objects have now been attained by a heat-sensitive recording material comprising a support having thereon a layer containing microcapsules containing at least a first component capable of undergoing a coloring reaction and an organic solvent in a core, and at least a second component causing said coloring reaction with said first component in the microcapsules, wherein two or more kinds of microcapsules comprising respective microcapsule walls having different glass transition points constitute said microcapsules.

BRIEF DESCRIPTION OF THE DRAWING

The FIGURE shows the relation between the applied energy applied to the heat-sensitive recording material and the printing density, where the curved lines (1) to (4) represent the following: (1) Example 1, (2) Example 2, (3) Example 3, and (4) Comparative Example.

DETAILED DESCRIPTION OF THE INVENTION

Differing from conventional recording materials in which a microcapsule is broken by heat or by a pressure so that a reactive material contained in the core of the microcapsule and a reactive material existing outside the microcapsule are caused to come into contact so as to generate a color forming reaction, the microcapsule according to the present invention is such that the reactive materials existing in the core of the microcapsule and outside the microcapsule are caused to react by allowing them to permeate through the wall of the microcapsule by application of heat. It has been known that in the case where a microcapsule wall is formed by a polymerizing method, the wall does not entirely become an impermeable film and has some permeability. Although the permeability of the microcapsule wall has been known as a phenomenon that a low molecular material is gradually permeated in a long time, such a phenomenon that permeance can be instantaneously obtained by heating has not been known prior to the present invention. Accordingly, it is not necessary that the microcapsule will according to the present invention is melted by heating.

The microcapsule wall is hardly fused even if the microcapsule is heated after core materials in the microcapsule solution according to the present invention is deleted. If microcapsule walls differ in glass transition point from each other, however, the printing density in response to applied energy is also different, and therefore the gradation reproducibility can be improved by using two or more kinds of microcapsules having different glass transition points.

In accordance with the present invention, the gradation reproducibility capable of changing the coloring density as well as the coloration temperature can be obtained by using the microcapsules each containing the same color forming component or the microcapsules each containing the same mixture comprising two or more kinds of color forming components in the same composition and proportion.

According to a preferred embodiment of the present invention, there is provided a multicoloring heat-sensitive recording material, wherein (a) said two or more kinds of microcapsules contain therein first coloring components for forming colors which are different in color tone, respectively, or (b) said second component which reacts with the first coloring component in said microcapsules comprises at least two kinds of components providing different color tones.

Features of the present invention are described below in more detail.

As the organic solvent used according to the present invention, it is preferable to use a solvent having a boiling point not lower than 180° C. because that of a low boiling point has evaporation losses in the shelf storage. Phosphate, phthalate, another carboxylate, fatty acid amide, alkylated biphenyl, alkylated terphenyl, chlorinated paraffin, alkylated naphthalene, diaryl ethane, and the like are used. As the specific examples therefor, tricresyl phosphate, trioctyl phosphate, octyl diphenyl phosphate, tricyclohexyl phosphate, dibutyl phthalate, dioctyl phthalate, dilauryl phthalate, dicyclohexyl phthalate, butyl oleate, diethylene glycol dibenzoate, dioctyl sebacate, dibutyl sebacate, dioctyl adipate, trioctyl trimellitate, acetyl triethyl citrate, octyl maleate, dibutyl maleate, isopropyl biphenyl, isoamyl biphenyl, chlorinated paraffin, diisopropyl naphthalene, 1,1'-ditolyl ethane, 2,4-ditertiary aminophenol, N,N'-dibutyl-2-butoxy-5-tertiaryoctyl aniline, and the like can be listed.

As the capsule wall material, good results can be obtained when the wall material is selected from polyurea, polyurethane, polyester, polyamide, ureaformalin resin, or a mixture thereof.

As the method of forming the walls of the microcapsules, the method in which microencapsulation is performed by polymerization of the reactant and deposition of polymers from the inside of the oil droplets is superior in obtaining a microcapsule having a wall which is minute and excellent in stability, the microcapsules being able to be easily controlled in its size as well as with respect to thickness of the walls.

This microencapsulation method and particular examples of the compounds used therefor are disclosed, e.g., in U.S. Pat. Nos. 3,726,804 and 3,796,669.

For example, when polyurethane is used as the wall material of the capsule, polyvalent isocyanate and a second material, for example, polyol, which reacts with the polyvalent isocyanate so as to form the capsule wall, are mixed with each other in an oil solution to be encapsulated and emulsified to be dispersed in the water. Next, the temperature is raised so that the polymer forming reaction is started in the interface of the oil droplets so as to form the wall of the microcapsule. At this time, an auxiliary solvent having a low boiling point and a strong dissolving power, e.g., ethylene chloride, can be used in the oil solution.

Polyisocyanates, and the mating polyols or polyamines to be reacted with the polyisocyanates are disclosed, e.g., in U.S. Pat. Nos. 3,281,383, 3,773,695, and 3,793,268, Japanese Patent Publication Nos. 40347/73 (corresponding to British Pat. No. 1,127,338), and 24159/74 (corresponding to U.S. Pat. No. 3,723,363), and Japanese Patent Application (OPI) Nos. 80191/73 (corresponding to U.S. Pat. No. 3,838,108), and 84086/73 (corresponding to British Pat. No. 1,416,224) (the term "OPI" as used herein refers to a "published unexamined Japanese patent application").

The process of preparing microcapsule walls according to the present invention is not limited to the above-described processes. All polymeric substances formed by the reaction of polyvalent isocyanate and polyol are preferably used as a capsule wall of the present invention. The glass transition point of the capsule wall may be varied by appropriate combinations of polyvalent isocyanate and polyol.

Typical examples of polyvalent isocyanate include diisocyanates such as m-phenylene diisocyanate, p-phenylene diisocyanate, 2,6-tolylene diisocyanate, 2,4-tolylene diisocyanate, naphthalene-1,4-diisocyanate, diphenyl methane-4,4'-diisocyanate, 3,3'-dimethoxy-4,4'-diphenyl diisocyanate, 3,3'-dimethyl diphenyl methane-4,4'-diisocyanate, xylylene-1,4-diisocyanate, 4,4'-diphenyl propane diisocyanate, trimethylene diisocyanate, hexamethylene diisocyanate, propylene-1,2-diisocyanate, butylene-1,2-diisocyanate, cyclohexylene-1,2-diisocyanate, cyclohexylene-1,4-diisocyanate and so on; triisocyanate such as 4,4',4''-triphenyl methane triisocyanate, toluene-2,4,6-triisocyanate and so on; tetraisocyanate such as 4,4'-dimethyl diphenyl methane-2,2',5,5'-tetraisocyanate and so on; and isocyanate prepolymers such as an addition product of hexamethylene diisocyanate/trimethylolpropane, an addition product of 2,4-tolylene diisocyanate/trimethylol propane, an addition product of xylylene diisocyanate/trimethylol propane or an addition product of tolylene diisocyanate/hexanetriol.

Typical examples of the polyol include aliphatic polyhydric alcohol, aromatic polyhydric alcohol, hydroxy polyester, hydroxy polyalkylene ether, and the like. Preferable polyols include polyhydroxy compounds having a molecular structure such that a group of the formula (I), (II), (III) or (IV) as described below exists between two hydroxyl groups, the molecular weight of which is not larger than 5,000 can be listed.

Aliphatic hydrocarbon group having carbon atom range of from 2 to 8; (I)

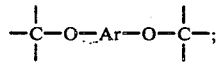
(II)

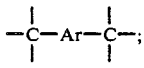
(III)

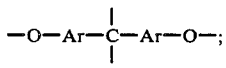
(IV)

wherein Ar in (II), (III) and (IV) represents a substituted or non-substituted aromatic portion, and the aliphatic hydrocarbon group of (I) is an aliphatic hydrocarbon group whose basic structure is $-C_nH_{2n}-$ in which the hydrogen group may be substituted for another element.

Examples of polyols comprising (I) include ethylene glycol, 1,3-propanediol, 1,4-butanediol, 1,5-pentanediol, 1,6-hexanediol, 1,7-heptanediol, 1,8-octanediol, propylene glycol, 2,3-dihydroxy butane, 1,2-dihydroxy butane, 1,3-dihydroxy butane, 2,2-dimethyl-1,3-propanediol, 2,4-pentanediol, 2,5-hexanediol, 3-methyl-1,5-pentanediol, 1,4-cyclohexane dimethanol, dihydroxy cyclohexane, diethylene glycol, 1,2,6-trihydroxy hexane, phenyl ethylene glycol, 1,1,1-trimethylol propane, hexanetriol, pentaerythritol, glycerol, and the like.

Examples of polyols comprising (II) include a condensation product of aromatic polyhydric alcohols, such as 1,4-di(2-hydroxyethoxy)benzene, resorcinol dihydroxyethyl ether, etc , and alkylene oxides.

Examples of polyols comprising (III) include p-xylylene glycol, m-xylylene glycol, $\alpha,\alpha'$-dihydroxy-p-diisopropylbenzene, and the like.

Examples of polyols comprising (IV) include 4,4'-dihydroxy-diphenyl methane, 2-(p,p'-dihydroxy diphenyl methyl)benzyl alcohol, an addition product of bisphenol A/ethylene oxide, an addition product of bisphenol A/propylene oxide, and the like. It is preferable to select polyol having from 0.02 to 2 mols of hydroxyl group per 1 mol of isocyanate group.

Examples of the polyamine, which can be used instead of the polyol, include ethylenediamine, trimethylenediamine, tetramethylenediamine, pentamethylenediamine, hexamethylenediamine, p-phenylenediamine, m-phenylenediamine, piperazine, 2-methylpiperazine, 2,5-dimethylpiperazine, 2-hydroxytrimethylenediamine, diethylenetriamine, triethylenetriamine, triethylenetetramine, diethylamino propylamine, tetraethylenepentamine, an addition product of an epoxy compound amine, and the like.

Further, the polyvalent isocyanate is able to form a polymeric substance as a preferred capsule wall by the reaction with water.

If other conditions are maintained unchanged, the wall thickness can be varied by changing an additive amount of polyisocyanate, polyol, or polyamine. If other conditions are maintained unchanged, the particle size, and therefore the wall thickness, can be varied by changing the state of agitation in emulsifying/dispersing.

When the microcapsule is prepared, a water-soluble polymer can be used. Preferred examples of water-soluble polymers include water-soluble anionic polymer, nonionic polymer, and amphoteric polymer. The anionic polymer may be natural or synthetic, and may include, for example, a $-COO^-$ group, an $-SO_3^-$ group, or the like. Specific examples of the anionic natural polymers include gum arabic, alginic acid, and the like. Semisynthetic anionic polymers include carboxymethyl cellulose, phthaloylated gelatin, sulfonated starch, sulfonated cellulose, lignin sulfonate, and the like. In addition, specific examples of synthetic anionic polymers include maleic anhydride copolymers (hydrolyzed materials are also included), an acrylic acid polymer and copolymer (a methacrylic acid group is also included), a vinylbenzenesulfonic acid polymer and copolymer, carboxyl-denatured polyvinyl alcohol, and the like.

Examples of nonionic polymers include polyvinyl alcohol, hydroxyethyl cellulose, methyl cellulose, etc.

Examples of the amphoteric polymer include gelatin or the like.

The water-soluble polymers can be used in the form of a water solution having a concentration of from 0.01 to 10 wt %.

The glass transition point of the capsule wall according to the present invention is a glass transition point "as a system" including effects of a coupler, a basic substance, a coloring accelerator, and the like.

That is, the glass transition point is either the particular glass transition point of the capsule wall, or the glass transition point under the condition in which a material outside the capsule (particularly, a glass transition point modifier) is melted when heated to diffuse/permeate into the capsule wall to thereby cause interaction therewith in thermal printing. A method of controlling the former, i.e., the inherent glass transition point of the capsule wall, is to vary the kind of the capsule wall forming agent. In the case of a capsule of polyurea, polyurethane or a mixture of polyurea-polyurethane, this method is particularly advantageous because the glass transition point can be significantly varied by changing the kind of isocyanate to be used and by changing the kind and amount of the polyol or polyamine to be used.

It is possible to vary the latter glass transition point under the condition in which the interaction is caused by disposing a glass transition point modifier outside the capsule. A hydroxy compound having a melting point of from 50° to 170° C., carbanate, an aromatic methoxy compound, an organic sulfonamide compound, and the like, are particularly effective.

Examples of the hydroxy compound include a phenol compound such as p-t-butylphenol, p-t-octylphenol, p-$\alpha$-cumylphenol, p-t-pentylphenol, m-xylenol, 2,5-dimethylphenol, 2,4,5-trimethylphenol, 3-methyl-4-isopropylphenol, p-benzylphenol, o-cyclohexylphenol, p-(diphenylmethyl)phenol, p-($\alpha,\alpha$-diphenylethyl)-phenol, o-phenylphenol, ethyl p-hydroxybenzoate, propyl p-hydroxybenzoate, butyl p-hydroxybenzoate, benzyl p-hydroxybenzoate, p-methoxyphenol, p-butoxyphenol, p-heptyloxyphenol, p-benzyloxyphenol, dimethyl 3-hydroxyphthalate, vanillin, 1,1-bis(4-hydroxyphenyl)dodecane, 1,1-bis(4-hydroxyphenyl)-2-ethylhexane, 1,1-bis(4-hydroxyphenyl)-2-methyl-pentane, 2,2-bis(4-hydroxyphenyl)heptane, 2-t-butyl-4-methoxyphenol, 2,6-dimethoxyphenol, 2,2'-dihydroxy-4-methoxybenzophenone, or the like; and an alcohol compound such as 2,5-dimethyl-2,5-hexanediol, resorcinol-di(2-hydroxyethyl)ether, resorcinolmono(2-hydroxyethyl)ether, salicylalcohol, 1,4-di(hydroxyethoxy)benzene, p-xylylenediol, 1-phenyl-1,2-ethanediol, diphenylmethanol, 1,1-diphenylethanol, 2-methyl-2-phenyl-1,3-propanediol, 2,6-dihydroxymethyl-p-cresolbenzylether, 3-(o-methoxyphenoxy)-1,2-propanediol, and the like. Examples of carbamates include ethyl N-phenylcarbamate, benzyl N-phenylcarbamate, phenethyl N-phenylcarbamate, benzylcarbamate, butylcarbamate, isopropylcarbamate, and the like.

Examples of the aromatic methoxy compound include 2-methoxybenzoic acid, 3,5-dimethoxyphenyl acetic acid, 2-methoxynaphthalene, 1,3,5-trimethoxybenzene, p-dimethoxybenzene, p-benzyloxymethoxybenzene, and the like.

Specific examples of organic sulfonamide compounds which can be employed in the present invention include p-toluenesulfonamide, o-toluenesulfonamide, benzenesulfonamide, p-toluenesulfonanilide, N-(p-methoxyphenyl)-p-toluenesulfonamide, N-(o-methoxyphenyl)-p-toluenesulfonamide, N-(p-chlorophenyl)-p-toluenesulfonamide, N-(o-chlorophenyl)-p-toluenesulfonamide, N-(p-tolyl)-p-toluenesulfonamide, N-(o-tolyl)-p-toluenesulfonamide, N-(o-hydroxyphenyl)-p-toluenesulfonamide, N-benzyl-p-toluenesulfonamide, N-(2-phenethyl)-p-toluenesulfonamide, N-(2-hydroxyethyl)-p-toluenesulfonamide, N-(3-methoxypropyl)-p-toluenesulfonamide, methanesulfonanilide, N-(p-tolyl)-sulfonamide, N-(o-tolyl)sulfonamide, N-(p-methoxyphenyl)sulfonamide, N-(o-methoxy)sulfonamide, N-(p-chlorophenyl)sylfonamide, N-(o-chlorophenyl)sulfonamide, N-(2,4-xylyl)sulfonamide, N-(p-ethoxyphenyl)-sulfonamide, N-benzylmethanesulfonamide, N-(2-phenoxyethyl)methanesulfonamide, 1,3-bis(methanesulfonylamino)benzene, 1,3-bis(p-toluenesulfonylamino)-propane, and so on. However, the present invention is not to be construed as being limited to the compounds set forth above.

These glass transition point modifiers are able to control a glass transition point of the capsule wall by the preparation of microcapsules together with a core material of the microcapsules. The glass transition point modifier is preferably used in an amount of from 0.01 to 1 part by weight, and more preferably from 0.01 to 0.2 part by weight, most preferably 0.04 to 0.08 part by weight, per 1 part by weight of the capsule wall material.

The expression "glass transition point" refers to a peak temperature of tan δ defined by the following equation which is obtained by measuring a capsule wall or a product due to interaction between the capsule wall and a glass transition point modifier outside the capsule by using Vibron Model DDV-III type (manufactured by Toyo Baldwin Co., Ltd.) and which is obtained by dividing a dynamic loss modulus by a dynamic modulus. These dynamic modulus and dynamic loss modulus are described in L. E. Nielsen, *Mechanical Property of Polymers,* Marcel Dekker Inc., New York (1975).

$$\tan \delta = \frac{\text{Dynamic Loss Modulus}}{\text{Dynamic Modulus}}$$

The preferred difference in the glass transition points of the microcapsule walls used in the present invention is about 20° C. to 200° C., more preferably 20° C. to 150° C.

The coloring enabling temperature of heat-sensitive paper using capsules is determined when the glass transition point of the capsule wall "as a system" is determined. This is because when the capsule wall is varied from a glassy status to a rubbery status, material diffusion is caused inside and outside the capsule to generate a coloring reaction.

Preparation of the capsule walls and the products due to interaction between the capsule wall and the heat fusible material, which are subject to the measurement of the glass transition point, is preformed, for example, in a manner as follows:

20 parts(wt) of the addition product of. xylylene diisocyanate/trimethylolpropane (3/1 in molar ratio) as the component of the capsule wall were dissolved in 30 parts(wt) of ethyl acetate. The reaction solution was bar-applied onto a polyethylene sheet, reacted at 40° C. to 60° C. in water, peeled off, and then dried by forced air at 24° C. in 64% R.H. (relative humidity) for one day, thereby obtaining a polyurea film having a thickness of from 10 to 20 μm. This is a sample to be subject to the measurement of the particular glass transition point of only the capsule wall. The method of preparing the product by interaction between the heat fusible material and the capsule wall was performed in such a manner that the polyurea film as described above was dipped in a 20% methanol solution of p-benzyl oxyphenol for 30 hours and then dried by forced air at 24° C. in 64% R.H. for one day, thus obtaining a sample.

Preferred modes to be used in the heat-sensitive recording materials according to the present invention are as follows:

(1) A heat-sensitive recording material comprising a support having thereon a layer containing a capsule containing a leuco dye and an organic solvent as a core material, and a developer for causing the leuco dye to color.

(2) A heat-sensitive recording material described in the above item (1), in which at least a part of the organic solvent is substituted by a vinyl compound and in which a photopolymerization initiator is contained or not.

(3) A heat-sensitive recording material comprising a support having thereon a layer containing a capsule containing a diazo compound as a core material, and the coupling agent capable of coupling with the diazo compound.

(4) A heat-sensitive recording material comprising a support having thereon a layer containing a capsule containing a leuco dye as a core material, a capsule containing a diazo compound as a core material, a color developer and a coupling agent.

As the leuco dye used for the heat-sensitive recording material (1) or (4) according to the present invention, for example, there are crystal violet lactone, 3-indolino-3-p-dimethylaminophenyl-6-dimethylaminophthalide, 3-diethylamino-7-chlorofluoran, 3-diethylamino-7-cyclohexylaminofluoran, 3-diethylamino-5-methyl-7-t-butylfluoran, 3-diethylamino-6-methyl-7-anilinofluoran, 3-diethylamino-6-methyl-7-p-butylanilinofluoran, 2-(N-phenyl-n-ethyl)aminofluoran, 3-diethylamino-7-dibenzylaminofluoran, 3-cyclohexylamino-6-chlorofluoran, 3-diethylamino-6-methyl-7-xylidinofluoran, 2-anilino-3-methyl-6-(N-ethyl-p-toluidino)fluoran, 3-pyrrolidino-6-methyl-7-anilinofluoran, 3-pyrrolidino-7-cyclohexylaminofluoran, 3-piperidino-6-methyl-7-toluidinofluoran, 3-pyrrolidino-6-methyl-7-(p-toluidino)fluoran, 3-piperidino-6-methyl-7-anilinofluoran, 3-N-methylcyclohexylamino-6-methyl-7-anilinofluoran, 3-diethylamino-7-(m-trifluoromethylaniline)fluoran, and the like. However, the leuco dye is not limited to the examples described above.

As the developer with respect to these coloring agents, a phenol compound, organic acid, the metal salt thereof, oxybenzoate, and the like are used.

It is preferable to use phenol and organic acid which are difficult to dissolve in water in which have a melting point of from 50° C. to 250° C., and more preferably from 60° C. to 200° C.

As the examples of the phenol compound, there are 4,4'-isopropylidene-diphenol (bisphenol A), p-tert-butylphenol, 2,4-dinitrophenol, 3,4-dichlorophenol, 4,4'-methylene-bis(2,6-di-tert-butylphenol), p-phenylphenol, 4,4-cyclohexylidenediphenol, 2,2'-methylene-bis(4-tert-butylphenol), 2,2'-methylene-bis(α-phenyl-p-cresol)thiodiphenol, 4,4-thiobis(6-tert-butyl-m-cresol), sulfonyldiphenol, 1,1-bis(4-hydroxyphenyl)-n-dodecane, 4,4-bis(4-hydroxyphenyl)-1-pentanoic ethyl ester, and, in addition to the phenol compound, a p-tert-butylphenol-formalin condensate, a p-phenylphenol-formalin condensate, and the like.

As the organic acid and the metal salt thereof, the organic salt such as 3-tert-butyl salicylate, 3,5-tert-butyl salicylate, 5-α-methylbenzyl salicylate, 3,5-di-α-methylbenzyl salicylate, 3-tert-octyl salicylate, 5-α,γ-dimethyl-α-phenyl-γ-phenylpropyl salicylate, and the like, and the metal salt thereof such as zinc salt, lead salt, aluminum salt, magnesium salt, and nickel salt are useful.

As the oxybenzoate, there are p-ethyloxybenzoate, p-butyloxybenzoate, p-heptyloxybenzoate, p-benzyloxybenzoate, and the like.

Vinyl compounds to be used in the heat-sensitive recording material (2) according to the present invention may be a compound having at least one, and preferably a plurality of, vinyl or vinylidene groups, such as a compound having an acryloyl group, a methacryloyl group, an allyl group, an unsaturated polyester group, a vinyloxy group, an acrylamide group and the like. The most typical compounds are a reaction product between unsaturated carboxylic acid and polyol, polyamine, amino alcohol, or the like, a reaction product between polyisocyanate and acrylate or methacrylate each having a hydroxyl group, and the like.

Typical compounds, for example, are as follows: polyethylene glycol diacrylate, propylene glycol dimethacrylate, pentaerythritol triacrylate, trimethylolpropane diacrylate, trimethylolpropane triacrylate, pentaerythritol tetraacrylate, hexanediol diacrylate, 1,2-butanediol diacrylate, tetrakisacryloxyethylethylenediamine, a reaction product between epoxy resin and acrylic acid, a reaction product of methacrylic acid pentaerythritol and acrylic acid, a condensate of maleic acid, diethylene glycol, and acrylic acid, methyl methacrylate, butyl methacrylate, styrene, divinylbenzene, diaryl naphthalene, and the like. Also, a plurality thereof can be used together depending on the purpose.

The photopolymerizing initiator used in the heat-sensitive recording material (2) according to the present invention includes a single organic/inorganic compound or a combination thereof capable of initiating polymerization of the vinyl compounds by irradiation.

As to the raw materials for such a photopolymerizing initiator, description has been made in detail in various documents, for example, such as Kosar, *Light-Sensitive Systems,* published by John Wiley & Sons, Warashina et al., *Photosensitive Resin,* published by Industrial Daily News Co., Ltd., and Kakuta et al., *Photosensitive Resin,* published by the Japan Society of Printing Science and Technology, and the like.

As the specific photopolymerizing initiators, an aromatic ketone compound, a quinone compound, an ether compound and a nitro compound can be listed, by way of example.

Specifically, benzoquinone, phenanthrenequinone, naphthoquinone, diisopropylphenanthrenequinone, benzoin butyl ether, benzoin, furoinbutyl ether, Michler's ketone, Michler's thioketone, tetraphenylfuroindimer, fluorenone, trinitrofluorenone, β-benzoylaminonaphthalene and the like are included.

The photopolymerizing initiator is added in a proportion of about 0.1 to 30 weight percent based on the vinyl compound.

The additive amount per unit area is generally selected to be from 0.05 to 1.5 g, and preferably from 0.05 to 0.8 g, for the leuco dye; from 0.3 to 8 g, and preferably from 0.5 to 5 g, for the developer; and from 0.1 to 15 g, and preferably from 0.1 to 8 g, for the organic solvent in the core material. Further, the organic solvent can be substituted by a vinyl compound with a desired ratio.

The diazo compound used in the heat-sensitive material (3) or (4) according to the present invention is diazonium salt represented by the formula $ArN_2^+ X^-$ (in which Ar represents a substituted or unsubstituted aromatic moiety, $N_2^+$ represents a diazonium group, and $X^-$ represents acid anion), and the compound can cause a coupling reaction to perform color forming together with the coupling component and can be decomposed by irradiation.

Specific examples of the diazonium forming the diazonium salts are as follows: 4-diazo-1-dimethylaminobenzene, 4-diazo-1-diethylaminobenzene, 4-diazo-1-dipropylaminobenzene, 4-diazo-1-methylbenzylaminobenzene, 4-diazo-1-dibenzylaminobenzene, 4-diazo-1-ethylhydroxyethylaminobenzene, 4-diazo-1-diethylamino-3-methoxybenzene, 4-diazo-1-dimethylamino-2-methylbenzene, 4-diazo-1-benzoylamino-2,5-diethoxybenzene, 4-diazo-1-morpholinobenzene, 4-diazo-1-morpholino-2,5-diethoxybenzene, 4-diazo-1-morpholino-2,5-dibutoxybenzene, 4-diazo-1-anilinobenzene, 4-diazo-1-toluylmercapto-2,5-diethoxybenzene, 4-diazo-1,4-methoxybenzoylamino-2,5-diethoxybenzene and the like.

The specific examples of the acid anions are as follows: $C_nF_{2n+1}COO^-$ (n represents an integer of 3 to 9); $C_mF_{2m+1}SO_3^-$ (m represents an integer of 2 to 8); $(C_lF_{2l+1}SO_2)_2CH^-$ (l represents an integer of 1 to 18);

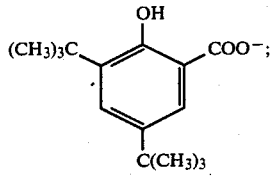

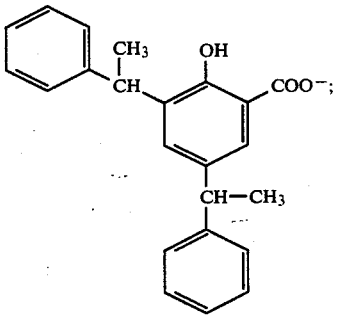

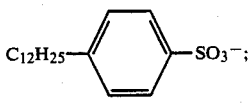

-continued

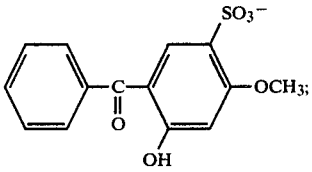

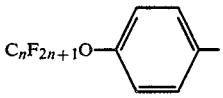

$C_nF_{2n+1}O-$ $-SO_3^-$ (n represents an integer of 3 to 9);

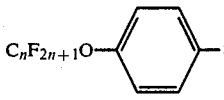

$C_nF_{2n+1}O-$ $-SO_2-N(CH_3)-CH_2CO_2^-$ (n represents an integer of 3 to 9);

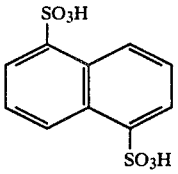

; $BF_4^-$; $PF_6^-$; and the like.

More specifically, among the acid anions, acid anions containing a perfluoroalkyl group, a perfluoroalkenyl group, or the group $PF_6^-$ are preferable because they can contribute to the repression of increase in fog upon storage prior to recording.

Specific examples of the diazo compounds (that is, the diazonium salts) are as follows:

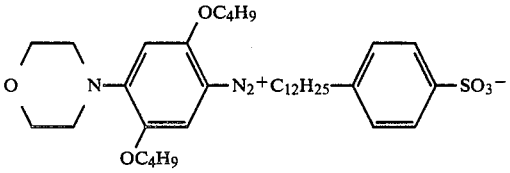

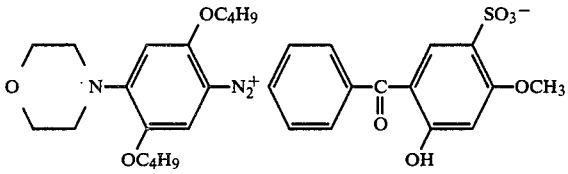

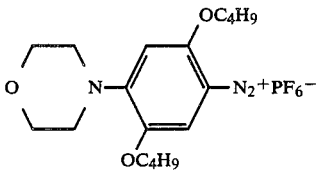

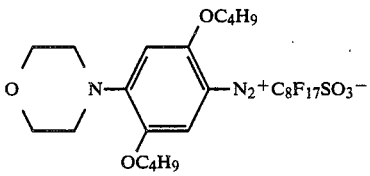

-continued

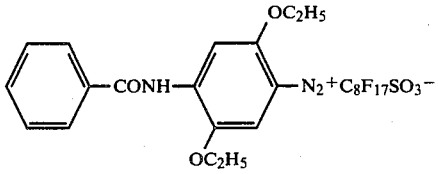

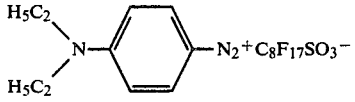

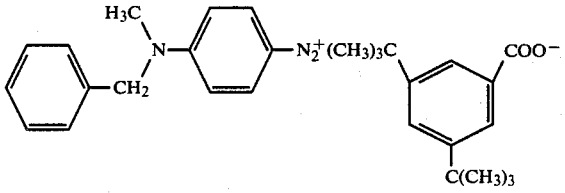

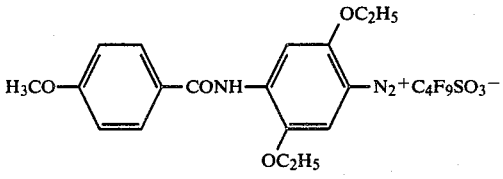

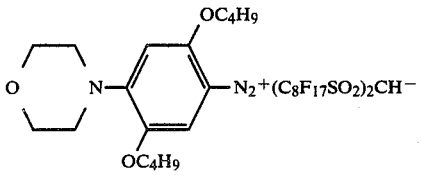

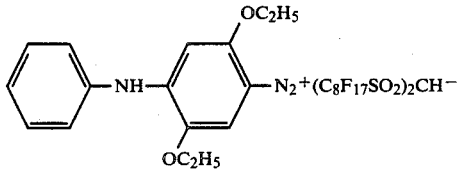

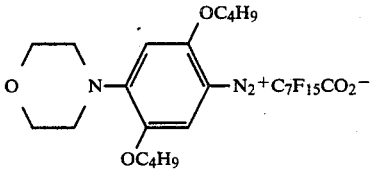

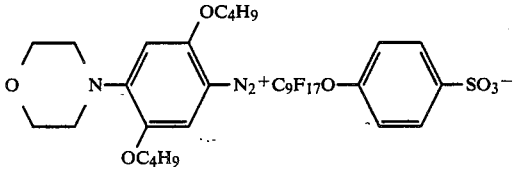

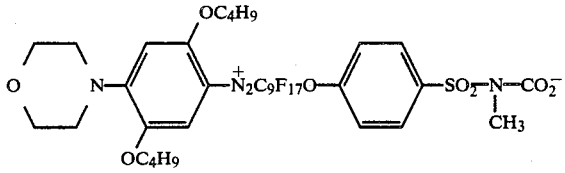

The coupling component to be used in the present invention is a compound which couples with the diazo compound (diazonium salt) to form a dye. Such a coupling component includes a compound of the type that the coloration is accelerated depending upon the presence of a basic substance, and a compound of the type that the high coloration density is obtained regardless of the presence of a basic substance. The typical examples of the former type coupling components depending upon the basic substance include resorcin, phloroglucin, 2,3-dihydroxy naphthalene-6-sodium sulfonate, 1-hydroxy-2-naphthoic morpholino propylamide, 1,5-dihydroxy naphthalene, 2,3-dihydroxy naphthalene, 2,3-dihydroxy-6-sulfanil naphthalene, 2-hydroxy-3-naphthoanilide, 2-hydroxy-3-naphthoic acid-2'-methyl anilide, 2-hydroxy-3-naphthoic ethanolamide, 2-hydroxy-3-naphthoic octylamide, 2-hydroxy-3-naphthoic acid-N-dodecyloxypropylamide, 2-hydroxy-3-naphthoic tetradecylamide, acetanilide, acetoacetanilide, benzoylacetanilide, 1-phenyl-3-methyl-5-pyrazolone, 1-(2',4',6'-trichlorophenyl)-3-benzamide-5-pyrazolone, 1-(2',4',6'-trichlorophenyl)-3-anilino-5-pyrazolone, 1-phenyl-3-phenylacetamide-5-pyrazolone, etc. Typical examples of the latter type coupling components regardless of the presence of a basic substance include an active methylene compounds, for example, β-ketocarboxylic acid amides such as benzoylacetanilide, pivaloylacetanilide, 1,3-bis(benzoylacetamino)toluene, 1,3-bis(pivaloylacetaminomethyl)benzene, etc., pyrazolones such as 3-methyl-1-phenylpyrazolone, 3-hexylcarbamoyl-1-phenylpyrazolone, 3-myristoylamino-1-(2,4,6-trichlorophenyl)pyrazolone, etc., barbituric acids such as 1,3-didodecylbarbituric acid, 1,3-dicyclohexylbarbituric acid, 1-octyl-3-stearylbarbituric acid, etc., 1,3-cyclohexanediones such as 5,5-dimethyl-1,3-cyclohexanedione, 5,5-dimethyl-4-phenyl-1,3-cyclohexanedione, etc.; an aromatic amine type compound, for example, α-naphthylamine, β-naphthylamine, 1-anilinonaphthalene, 2-anilinonaphthalene, 3-aminodiphenylamine, 4,4'-diaminodiphenylmethane, N,N-dicyclohexylaniline, 2-aminocarbazole, 2-phenylindole, 1-phenyl-2-methylindole, and an organic or inorganic acid salt of an aromatic amine such as a p-toluenesulfonic acid salt of N,N-dimethylaniline and α-naphthylamine hydrochloride, etc.; and an aromatic hydroxy compounds having a basic group in the molecular structure thereof, for example, 2-hydroxy-3-naphthoic acid-3'-morpholinopropylamide, 2-hydroxy-3-naphthoic acid-2'-diethylaminoethylamide, 2-hydroxy-3-naphthoic acid-3-piperidinopropylamide, 2-hydroxy-3-naphthoic acid-3'-piperidinopropylamide, 2-hydroxy-3-naphthoic acid-p-(3'-N'-cyanoguanidinopropyl)oxyanilide, salicylic acid-p-(3'-morpholinopropyl)oxyanilide, 1-naphthol-4-sulfonic acid-3'-diethylaminopropylamide, 8-hydroxyquinoline-4-sulfonic acid-2'-diethylaminoethylamide, and an aromatic hydroxy compound having a residue such as an organic carboxylic acid salt of amines capable of forming basic when heated, e.g., a trichloroacetic acid salt of 2-hydroxy-3-naphthoic acid-3'-morpholinopropylamide, a phenylthioacetic acid salt of 1-naphthol-4-sulfonic acid-3'-diethylaminopropylamide, etc. An image of a particularly desired color may be obtained by using two or more of these coupling components in combination.

As the basic substance to be used for further acclerating the coloration in the preferred embodiment of the present invention, slightly water-soluble or water-soluble basic substances and those substances which produce alkali upon being heated are used.

Examples of useful basic substances include nitrogen-containing compounds such as inorganic and organic ammonium salts, organic amines, amides, urea, thiourea and the derivatives thereof, thiazoles, pyrroles, pyrimidines, piperadines, guanidines, indoles, imidazoles, imidazolines, triazoles, morpholines, piperidines, amidines, formamidines, pyridines, etc. The specific examples are as follows: ammonium acetate, tricyclohexylamine, tribenzylamine, octadecylbenzylamine, stearylamine, allylurea, thiourea, methylthiourea, allylthiourea, ethylenethiourea, 2-benzylimidazole, 4-phenylimidazole, 2-phenyl-4-methylimidazole, 2-undecylimidazoline, 2,4,5-trifuryl-2-imidazoline, 1,2-diphenyl-4,4-dimethyl-2-imidazoline, 2-phenyl-2-imidazoline, 1,2,3-triphenylguanidine, 1,2-ditolylguanidine, 1,2-dicyclohexylguanidine, 1,2,3-tricyclohexylguanidine, guanidine trichloroacetate, N,N'-dibenzylpiperazine, 4,4'-dithiomorpholine, morpholinium trichloroacetate, 2-aminobenzothiazole, 2-benzoylhydrazinobenzothiazole, etc. These basic substances can be used in combinations of two or more thereof.

As to the materials which are not contained in microcapsules, it is preferable to use them in the state they are solid-dispersed by a sand mill or the like. In the case of two or more kinds of materials, although such materials are usually separately dispersed in the individual solutions of the water-solyble polymer, this is not a restriction. Preferable water-soluble polymers include the water-soluble polymer used in preparing the microcapsule. At this time the concentration of the water-soluble polymer is from 2 to 30 wt % and the material is put into the solution of this water-soluble polymer so as to be dispersed in a range of from 5 to 40 wt % relative to the solution of the water-soluble polymer.

As a layer structure of the heat-sensitive material according to the present invention, at least one heat-sensitive layer is provided. In the case where only one heat-sensitive layer is formed, two or more kinds of capsules having glass transition points different from each other can be used in mixture.

In the case of two layers, it is convenient to dispose a heat-sensitive layer of lower sensitivity containing a capsule having a higher glass transition point "as a system" close to the support while a heat-sensitive layer of higher sensitivity containing a capsule having a lower glass transition point "as a system" is disposed farther from the support. In the case of not less than three layers, the same rule applies.

The case of the capsules as described above can be combined with such a multilayer structure.

Further, in the case where the particle size of a material disposed outside a capsule has a finite value, the material is not entirely fused by heat by a thermal head, and entirely fused when applied energy becomes large. Particularly, in the case where two or more kinds of materials outside the capsule, which are dispersed in a solid state, are fused with each other, such a phenomenon due to particle size as described above is apt to occur and this phenomenon can be advantageously utilized when gradation is required. Further, such a technique that distribution is proved in the thickness of a capsule wall can be advantageously utilized in combination with the various factors as described above.

In the case of the multilayer structure, the layers can be applied successively, or alternatively can be applied at the same time (e.g., by simultaneous curtain coating).

In the heat-sensitive recording materials (1), (2), (3) and (4) according to the present invention, for the purpose of preventing sticking with respect to the thermal head and of improving in a writing property, pigment such as silica, barium sulfate, titanium oxide, aluminum hydroxide, zinc oxide, calcium carbonate, or the like, and fine powder of styrene beads or ureamelamine resin, can be used.

Similarly, metal soaps also can be used to prevent sticking. The amount of such a material to be used is generally from 0.2 to 7 g/m$^2$.

Further, in the heat-sensitive recording materials (1) and (2) according to the present invention, heat fusible material can be used to improve the concentration of thermal recording. The heat fusible material may be a material which is solid at room temperature, can be fused by heating with a thermal head as they have a melting point of 50° to 150° C., and can dissolve the leuco dye, the developer, the diazo compound, the coupling components, or the basic substance. The heat fusible material is dispersed in the form of particles of 0.1 to 10$\mu$ and used in an amount of 0.2 to 7 g/m$^2$ of the solid basis. As the specific example of the heat fusible material, fatty acid amide, N-substituted fatty acid amide, a ketone compound, an N-substituted carbonate compound, a urea compound, ester, etc., can be listed.

Heat-sensitive recording materials (1), (2),(3), and (4) as described above according to the present invention can be applied by using an appropriate binder.

As the binder, polyvinyl alcohol, methyl cellulose, carboxymethyl cellulose, hydroxypropyl cellulose, gum arabic, gelatin, polyvinylpyrrolidone, casein, styrene-butadiene latex, acrylonitrile-butadiene latex, polyvinyl acetate, polyacrylic acid ester or copolymer of ethylene vinyl acetate, may be used in the form of emulsion. The amount of the binder to be used is generally from 0.5 to 5 g/m$^2$ of the solid basis.

According to the present invention, as the acid stabilizer, for example, citric acid, tartaric acid, oxalic acid, boric acid, phosphoric acid, or pyrophosphoric acid may be added to the raw materials as described above.

In the heat-sensitive recording materials (1), (2) (3) and (4) according to the present invention, at least one of the first coloring component capable of undergoing a color reaction is dissolved or dispersed in the solvent and then microencapsulated. Remainder second coloring component is solid-dispersed or converted to an aqueous solution thereof which is mixed with the dispersed solution of the microcapsule as described above so as to prepare a coating solution. The coating solution is applied onto a support such as a sheet of paper, a synthetic resin film, or the like, through a suitable application method such as bar coating, blade coating, air knife coating, gravure coating, roll coating, spray coating, dip coating, or the like, and dried so as to provide a heat-sensitive layer at a dry coverage of from 2.5 to 25 g/m$^2$.

As the paper used for a support, a neutral paper which is sized by a neutral sizing agent such as alkylketene dimer, or the like, and which has thermal extraction pH of 6 to 9 (which is disclosed in Japanese Patent Application (OPI) No. 14281/80 (corresponding to U.S. Pat. No. 4,255,491)), is advantageous for preservation in aging.

Further, in order to prevent a coating solution from permeating into paper and to improve the contact between a recording thermal head and a heat-sensitive recording layer, it is favorable to use the papers having the characteristic of $$\frac{\text{Stockigt Sizing Degree}}{\text{Basis Weight in Grams per Square Meter (m}^2\text{)}} \geqq 3 \times 10^{-3}$$

and a Beck smoothness of 90 seconds or more, as disclosed in Japanese Patent Application (OPI) No. 116687/82 (corresponding to U.S. Pat. No. 4,416,939).

Also, the paper which has optical surface roughness not larger than 8 $\mu$m and a thickness of 40 to 75 $\mu$m, as disclosed in Japanese Patent Application (OPI) No. 136492/83; the paper which has density not larger than 0.9 g/cm$^3$ and a rate of optical contact not smaller than 15%, as disclosed in Japanese Patent Application (OPI) No. 69091/85 (corresponding to U.S. patent applicatcn Ser. No. 436,083); the paper which is made from pulp broken into pieces not lower than 400 cc in the Canadian standard freeness (JIS P8121) and in which a coating solution is prevented from permeating, as disclosed in Japanese Patent Application (OPI) No. 69097/83 (corresponding to U.S. patent application Ser. No. 435,803); the paper in which original paper made by using Yankee Machine is used with its glossy surface formed with an applied layer to thereby improve in coloring density as well as in resolution, as disclosed in Japanese Patent Application (OPI) No. 65695/83 (corresponding to U.S. Pat. No. 4,466,007); the paper in which a corona discharge treatment is performed on original paper to improve in its application aptitude, as disclosed in Japanese Patent Application (OPI) No. 35985/84; and the like, may be used according to the present invention, with good results.

Furthermore, any support ordinarily used in the field of heat-sensitive recording paper can be used as a support according to the present invention.

The heat-sensitive recording materials (1), (2), (3) and (4) according to the present invention can be used as printing paper for facsimile equipment and electronic computers in which superior gradation recording as well as high speed recording are required, and moreover the heat-sensitive recording materials (2) and (3) can be fixed in such a way that after thermal printing, the capsule is exposed to be photohardened so as to be made inactive, and unreacted diazo compound is decomposed. The heat-sensitive recording materials can be used as the thermally developing copy paper in addition to the printing paper.

The present invention is illustrated in greater detail by reference to the following examples. However, the present invention is not limited to those examples. Unless otherwise indicated, all parts are by weight.

EXAMPLE 1

Two kinds of capsules were made by using the following diazo compound:

Diazo Compound

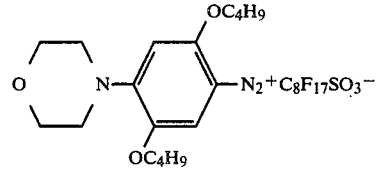

Capsule Solution A

Two parts of the diazo compound and 18 parts of an addition product of xylylenediisocyanate and trimethylolpropane (3/1 in molar ratio) were added to a mixed solvent of 24 parts of dibutyl phthalate and 5 parts of ethyl acetate so as to be dissolved. The resulting solution of the diazo compound was mixed with the aqueous solution prepared by dissolving 3.5 parts of polyvinyl alcohol, 1.7 parts of gelatin, and 2.4 parts of 1,4-di(2-hydroxyethoxy)benzene in 58 parts of water, and dispersed in an emulsified condition at 20° C. The emulsified solution having the average particle diameter of 3 μm was obtained. 100 parts of water was added to the thus obtained emulsified solution and heated at 60° C. while agitating them. After two hours the capsule solution A containing the diazo compound as the core material was obtained.

Capsule Solution B

The following alteration was effected in the way preparation of the capsule solution A, a capsule solution B was prepared.

In place of 18 parts of the addition product of the xylylenediisocyanate and the trimethylolpropane (3/1 in molar ratio), used were 18 parts of the same compound and 6 parts of an addition product of toluylenediisocyanate and trimethylolpropane (3/1 in molar ratio). Further, the capsule solution B was obtained quite in the same manner as the capsule solution A except that 2.4 parts of 1,4-di(2-hydroxyethoxy)benzene was deleted from the composition of the aqueous solution.

Next, 20 parts of 2-hydroxy-3-naphthoanilide was added to 100 parts of a 5% polyvinyl alcohol aqueous solution and dispersed by a sand mill in about 24 hours to prepare a dispersion of the coupling component having an average particle diameter of 3 μm.

Then, 20 parts of triphenyl guanidine was added to 100 parts of a 5% polyvinyl alcohol aqueous solution and dispersed by a sand mill in about 24 hours to prepare a dispersion of triphenyl guanidine having an average particle diameter of 3 μm. Further, 20 parts of p-benzyloxyphenol was added to 100 parts of a 5% polyvinyl alcohol aqueous solution and dispersed by a sand mill in about 24 hours to prepare a dispersion of the p-tert-butylphenol having an average particle diameter of 3 μm.

30 parts of the thus obtained capsule solution A, 20 parts of the capsule solution B, 15 parts of the coupling component, and 15 parts of the triphenyl guanidine are mixed with each other to prepare a coating solution. The coating solution was applied by a bar coating method onto a smooth, wood free paper (having a basis weight of 50 g/m$^2$) by using a coating rod to an amount of 14 g/m$^2$ of the dry weight and dried at 45° C. for 30 minutes to produce a heat-sensitive recording material. The respective glass transition points "as a system" of the capsule walls of the capsule solutions A and B were 120° C. and 140° C.

EXAMPLE 2

15 parts of the dispersion of the coupling component and 15 parts of the dispersion of the triphenyl guanidine were added to 50 parts of the capsule solution B to prepare a coating solution for a first layer. Then, 15 parts of the dispersion of the coupling component, 15 parts of the dispersion of the triphenyl guanidine, and 15 parts of the p-benzyloxyphenol were added to 50 parts of the capsule solution A to prepare a coating solution for a second layer.

The coating solution for the first layer and the coating solution for the second layer were successively applied one after one to form a double layer structure onto wood free paper (having a basis weight of 50 g/m$^2$) by using a coating rod to the respective amounts of 6 g/m$^2$ and 7 g/m$^2$ of the dry weight, and the double layer structure was dried at 45° C. for 30 minutes to thereby obtain a heat-sensitive recording material. The glass transition point of the wall of the capsule used in the first layer coating solution was 140° C. and the glass transition point "as a system" of a product due to the interaction between the capsule wall used in the second layer coating solution and the p-benzyloxyphenol was 80° C. to 90° C.

EXAMPLE 3

A heat-sensitive recording material was obtained in the same manner as in Example 2 except that an intermediate layer of polyvinyl alcohol (the thickness of the dried film was 0.5 μm) was provided between the first and second layers of Example 2.

COMPARATIVE EXAMPLE 1

A heat-sensitive recording material was obtained in the same manner as in Example 1 except that 50 parts of the capsule solution A was used in place of 30 parts of the capsule solution A and 20 parts of the capsule solution B in Example 1.

Test Method

Thermal recording was performed onto the obtained heat-sensitive recording materials while varying the applied energy so as to perform thermal recording, exposed all over the surface thereof by using RICOPY SUPER DRY 100 (produced by RICOH Co., Ltd.), and fixed. Blue concentration of the thus obtained recorded picture was measured by using a Macbeth reflection densitometer. The results are as shown in FIG. 1.

The FIGURE shows that variation of printing density is gentle in each of Examples 1 to 3 in comparison with Comparative Example 1, particularly with respect to low amounts of applied energy, and thus the expression of gradation is superior to Comparative Example 1.

EXAMPLE 4

Two kinds of capsules were made by using the following diazo compound:

Diazo Compound

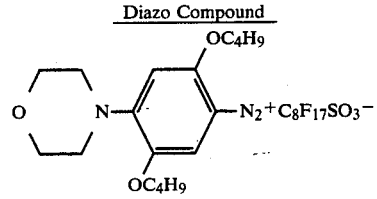

Capsule Solution C

Two parts of the diazo compound and 18 parts of an addition product of xylylenediisocyanate and trimethylolpropane (3/1 in molar ratio) were added to a mixed solvent of 24 parts of dibutyl phthalate and 5 parts of ethyl acetate so as to be dissolved. The resulting solution of the diazo compound was mixed with the aqueous solution prepared by dissolving 3.5 parts of polyvinyl alcohol, 1.7 parts of gelatin, and 2.4 parts of 1,4-di(2-hydroxyethoxy)benzene in 58 parts of water, and dispersed in an emulsified condition at 20° C. The emulsified solution having the average particle diameter of 3 μm was obtained. 100 parts of water was added to the thus obtained emulsified solution and heated at 60° C. while agitating them. After 2 hours the capsule solution C containing the diazo compound as the core material was obtained.

Capsule Solution D

Two parts of a diazo compound and 18 parts of the addition product (3/1 in molar ratio) of xylylenediisocyanate and trimethylolpropane were added to a mixture solvent of 24 parts of dibutyl phthalate and 5 parts of ethyl acetate, and dissolved. The resulting solution of the diazo compound was mixed into an aqueous solution prepared by dissolving 5.2 parts of polyvinyl alcohol in 58 parts of water, and emulsified and dispersed at 20° C. The emulsified solution having an average particle size of 3 μm was obtained. 100 parts of water was added to the thus obtained emulsified solution and the mixture was heated to 60° C. while stirring. After 2 hours, the capsule solution D containing a diazo compound as a core material was obtained.

Dispersion Solution 20 parts of 2-hydroxy-3-naphthoanilide was added to 100 parts of a 5% polyvinyl alcohol aqueous solution and dispersed by a sand mill in about 24 hours to prepare a dispersion A of the coupling component having an average particle diameter of 3 μm.

Then, 20 parts of the following Compound (I) was added to 100 parts of a 5% polyvinyl alcohol aqueous solution. Then, the dispersion B of a red coloring coupling component having an average particle size was similarly obtained.

Compound (I)

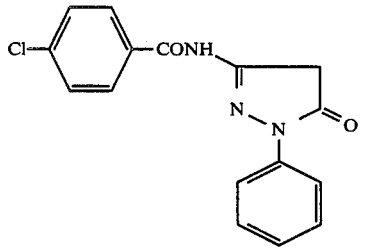

Then, 20 parts of triphenyl guanidine was added to 100 parts of a 5% polyvinyl alcohol aqueous solution and dispersed by a sand mill in about 24 hours to prepare a dispersion C of triphenyl guanidine having an average particle diameter of 3 μm.

Further, 20 parts of p-benzyloxyphenol was added to 100 parts of a 5% polyvinyl alcohol aqueous solution and dispersed by a sand mill in about 24 hours to prepare a dispersion D of the p-benzyloxyphenol having an average particle diameter of 3 μm.

19 parts of the dispersion B, 19 parts of the dispersion C, and 75 parts of the dispersion D were added to 85 parts of the thus obtained capsule solution C to prepare a coating solution (1). Further, a coating solution (2) was prepared in such a manner that 19 parts of the dispersion A and 19 parts of the dispersion C were added to 85 parts of the capsule solution D. These coating solutions (1) and (2) were applied successively in the order of (2) and (1) on flat wood free paper (having a basis weight of 50 g/m$^2$) so as to obtain a dry weight of 10 g/m$^2$ of each layer, and then dried for 30 minutes at 40° C. to produce a heat-sensitive recording material. The glass transition temperature of the capsule with the coating solution (1) was 75° C. and that with the coating solution (2) was 120° C.

When the thus obtained heat-sensitive recording material was heated for 1 second at a pressure of 300 g/m$^2$ by using a heat block of 100° C. and 130° C., the upper layer was colored with red at 100° C. and both of the upper and lower layers were colored at 130° C. so that a picture colored with red and blue was obtained. Thereafter, the picture image was exposed all over the surface thereof by using Ricopy Super Dry of Type 100 (produced by Ricoh Co., Ltd.) so as to be fixed.

EXAMPLE 5

A heat-sensitive recording material was obtained in the same manner as in Example 4 except that an intermediate layer made of polyvinyl alcohol (having a dry film thickness of 0.5 μm) was provided between the first and second layers in Example 1.

When the obtained heat-sensitive recording material was heated for 1 second by using a heat block of 100° C., the upper layer was only color formed in red similar to Example 1. When this heat-sensitive recording material was exposed, with a filter of density of 1.2 superimposed thereon, for 22 seconds by Ricopy Super Dry of Type 100 and then heated for 1 second by the heat block of 130° C., the upper layer was fixed without color forming in red and only the lower layer was color formed in blue. Then, the material was exposed again by using the above-mentioned Ricopy so as to be fixed completely. The same operation was performed by using a thermal head in place of the heating means. When a first and a second time printing operations were performed for 1.5 m seconds and for 3.0 m seconds respectively with an applied voltage of 16.7 volts, red and blue pictures could be obtained respectively.

EXAMPLE 6

Capsule Solution E

Two parts of the following leuco dye and 18 parts of addition product between xylylenediisocyanate and trimethylolpropane (3/1 in molar ratio) were added to a mixture solvent of 24 parts of diisopropylnaphthalene and 5 parts of ethyl acetate, and dissolved. The leuco dye solution was mixed into an aqueous solution prepared by dissolving 3.5 parts of polyvinyl alcohol, 1.7 parts of gelatin and 2.4 parts of 1,4-di-(2-hydroxyethoxy)benzene in 58 parts of water, and emulsified and dispersed at 20° C. The emulsified solution having an average particle size of 3 μm was obtained. 100 parts of water was added to the thus obtained emulsified solution and heated to 60° C. while stirring and a capsule colution E containing the leuco dye as its core material was obtained after 2 hours.

Leuco Dye

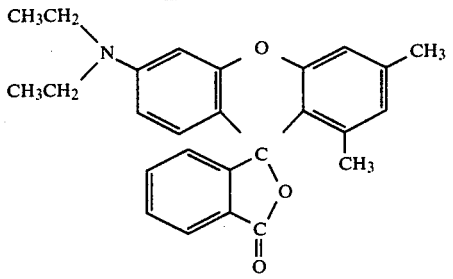

Capsule Solution F 2 parts of crystal violet lactone and 18 parts of an addition product of xylylenediisocyanate and trimethylolpropane (3/1 in molar ratio) were added to a mixture solvent of 24 parts of diisopropylnaphthalene and 5 parts of ethyl acetate, and dissolved. This crystal violet lactone solution was mixed into an aqueous solution prepared by dissolving 5.2 parts of polyvinyl alcohol to 58 parts of water, emulsified and dispersed at 20° C. The emulsified solution having an average particle size of 3 μm was obtained. 100 parts of water was added to the obtained emulsified solution and heated to 60° C. while stirring. After 2 hours, the capsule solution F containing crystal violet lactone as its core material was obtained.

Next, 20 parts of bisphenol A was added to 100 parts of a 5% polyvinyl alcohol aqueous solution and dispersed for about 24 hours with a sand mill to prepare a dispersion solution of bisphenol A having an average particle size of 3 μm.

30 parts, 20 parts, and 30 parts of the thus obtained capsule solutions E and F and bisphenol A dispersion solution, respectively, were added to prepare a coating solution. This coating solution was applied on flat wood free paper (having a basis weight of 50 g/m$^2$) by using a coating rod so as to obtain a dry weight of 15 g/m$^2$, and dried for 30 minutes at 40° C. to thereby obtain a heat-sensitive recording material. The glass transition temperature of the capsule solution E was 90° C. and that of the capsule solution F was 120° C.

When the obtained heat-sensitive recording material was heated for 1 second at 100° C. and 130° C. by using a heat block, a red picture was obtained at the low temperature and a picture colored with red and blue was obtained at the high temperature.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having thereon a layer containing microcapsules containing at least a first component capable of undergoing a coloring reaction and an organic solvent in a core, and at least a second component outside said microcapsules and causing said coloring reaction with said first component, wherein two or more kinds of microcapsules comprising respective microcapsule walls having different glass transition points constitute said microcapsules.

2. A heat-sensitive recording material as in claim 1, wherein the first coloring component incorporated in each microcapsule is the same component, or the same mixture comprising two or more kinds of color forming components in the same composition and proportion.

3. A heat-sensitive recording material as in claim 1, wherein:

(1) said two or more kinds of microcapsules contain therein first coloring components for forming colors which are different in color tone, respectively; or (b) said second component which reacts with the first coloring component in said microcapsules comprises at least two kinds of components providing different color tones.

4. A heat-sensitive recording material as in claim 1, wherein the capsule wall is produced by the reaction of polyvalent isocyanate and polyol.

5. A heat-sensitive recording material as in claim 1, wherein the microcapsule further contains a glass transition point modifier.

6. A heat-sensitive recording material as in claim 5, wherein the glass transition point modifier is selected from a hydroxy compound, a carbanate compound, an aromatic methoxy compound, and an organic sulfonamide compound.

7. A heat-sensitive recording material as in claim 1, wherein the first coloring component incorporated in the microcapsules is a leuco dye, and the second coloring component is a color developer.

8. A heat-sensitive recording material as in claim 7, wherein the microcapsule core further contains a vinyl compound.

9. A heat-sensitive recording material as in claim 1, wherein the first coloring component incorporated in the microcapsules is a diazo compound, and the second coloring component is a coupling agent.

10. A heat-sensitive recording material as in claim 1, wherein the microcapsules containing a first component are composed of a microcapsule containing a leuco dye and a microcapsule containing a diazo compound, and the second coloring components are a color developer and a coupling agent.

11. A heat-sensitive recording material as in claim 9, wherein said recording layer further contains a basic substance or a substance capable of becoming basic when heated.

12. A heat-sensitive recording material as in claim 10, wherein said recording layer further contains a basic substance or a substance capable of becoming basic when heated.

* * * * *